United States Patent [19]

Kersten, Jr.

[11] 4,084,270

[45] Apr. 18, 1978

[54] FREEZE PROOF EMERGENCY SHOWER UNIT

[75] Inventor: Samuel D. Kersten, Jr., Highland Park, Ill.

[73] Assignee: Water Saver Faucet Co., Inc., Chicago, Ill.

[21] Appl. No.: 702,525

[22] Filed: Jul. 6, 1976

[51] Int. Cl.[2] ..... A47K 3/22; A47K 3/00; A47K 3/08

[52] U.S. Cl. ..... 4/145; 4/147; 4/146; 4/153; 239/135

[58] Field of Search ..... 4/145, 146, 147, 148, 4/149, 151, 152, 153–156, 191, 192, 160

[56] References Cited

U.S. PATENT DOCUMENTS

| | | | |
|---|---|---|---|
| 2,042,278 | 5/1936 | Sloan | 4/145 |
| 2,454,518 | 11/1948 | McCann | 4/146 |
| 2,567,506 | 9/1951 | Bowman | 4/147 |
| 3,010,116 | 11/1961 | Cowley | 4/146 |
| 3,332,091 | 7/1967 | Greer | 4/155 |
| 3,651,523 | 3/1972 | Miyahara et al. | 4/145 |
| 3,939,503 | 2/1976 | Nazworth | 4/145 |
| 3,962,733 | 6/1976 | Parry | 4/145 |

*Primary Examiner*—Henry K. Artis

*Attorney, Agent, or Firm*—Wallenstein, Spangenberg, Hattis & Strampel

[57] ABSTRACT

A freeze proof emergency shower unit adapted for use outdoors, or within unheated industrial structures, comprising a walled enclosure mounted on a support base. A deluge or drench shower, and, optionally, an emergency eye/face wash fixture, extend outwardly from a wall of the enclosure. The valves necessary for the operation of the shower, and/or the eye/face wash fixture, are positioned within the enclosure, along with a storage tank for tempered water and a self-contained, or separate, heating unit for maintaining the water in the storage tank at a desired temperature. Push plates for operating the shower, and/or the eye/face wash fixture, are positioned within easy reach of a user standing under the shower or over the eye/face wash fixture.

6 Claims, 2 Drawing Figures

FREEZE PROOF EMERGENCY SHOWER UNIT

The present invention relates to a freeze proof emergency deluge safety shower unit capable of providing a high volume of tempered water under substantially any temperature conditions.

The necessity for freeze proof emergency shower units on industrial sites has been widely recognized. These units, more commonly referred to as "free-standing" drench or deluge showers, generally comprise a vertical pipe which is connected at its lower end to an underground water supply conduit buried below the frost line. The upper end of the vertical pipe is connected to a drench or deluge shower head. Not infrequently, an eye/face wash fixture is connected to the vertical pipe at a point between ground level and the shower head. Due to the fact that the units are located outdoors, or in unheated buildings, or structures, and, therefore, subject to freezing temperatures, it is necessary, in order to insure year-around operation, to utilize freeze proof valves in the units. Also, because such units may be used during periods when the air temperature is cold, by human standards, the water from the drench shower, and/or the eye/face wash fixture, should be tempered. In many instances, the units are merely connected to a source of tap water, no provision being made to temper the water. In one known instance where a drench shower capable of delivering tempered water is provided, the unit comprises a plastic pipe in which a water conduit is encased. Heating coils are spaced along the water conduit, and foam insulation is distributed between the outer and the inner pipes. While the unit is capable of delivering tempered water to the drench shower, and/or the eye/face wash fixture, freeze proof valves are still required. In addition, the outer plastic pipe, and the insulating material encased in it, make maintenance and repair of the unit extremely cumbersome and costly.

Apart from the foregoing considerations, conventional freeze proof emergency shower units, whether capable of supplying tempered water, or not, are lacking in distinctive structural characteristics which would make them more readily visible to a person who may need to use such a unit. Invariably, they essentially comprise, as stated above, simply a vertical pipe having an outwardly extending shower head connected to the upper end thereof. In certain instances, a red signal light is attached to the unit. This lack of easy visibility, coupled with the free-standing, open and exposed character of such installations, also makes them more susceptible not only to damage by vehicles moving about industrial sites, but, also, to damage resulting from vandalism.

In accordance with the present invention, an improved freeze proof emergency shower unit is provided which substantially eliminates all of the aforementioned shortcomings of conventional freeze proof emergency shower units. More specifically in this connection, the unit of this invention can be operated at temperatures substantially below freezing without the need for freeze proof valves. This feature of the unit, of course, represents an appreciable savings in cost both to the manufacturer and to the ultimate purchaser. The unit, moreover, stores, at all times, at the point of use, a large volume of tempered water which is maintained at a desired preselected temperature under substantially all weather conditions. All movable parts of the unit, as well as the tempered water storage means and water temperature control means, are easily accessible thereby facilitating repair and maintenance of the unit. The unit, furthermore, is readily visible, and its self-contained, rugged construction makes it far less susceptible to damage than is the case with conventional free-standing freeze proof emergency shower units.

The unit of the present invention, in brief, comprises a walled enclosure supported on a base. The enclosure is provided with a door, and the door, and each of the walls comprising the enclosure, and the ceiling, are insulated. A deluge or drench shower extends outwardly from one wall of the enclosure. In an alternative embodiment of the unit, an eye/face wash fixture extends outwardly from the same wall of the enclosure. Control means are provided within easy reach of the deluge or drench shower and the eye/face wash fixture for enabling a user to operate the shower and the eye/face wash fixture. Within the enclosure, there is provided a tempered water storage tank, and a water temperature control element. The water temperature control element may utilize electricity or gas to heat the water which is stored in the tempered water storage tank. The storage tank and the water temperature control element may comprise a self-contained body. Valves for controlling the operation of the deluge or drench shower and the eye/face wash fixture are also positioned within the enclosure. This arrangement eliminates the need for using more costly freeze proof valves as required in conventional emergency shower installations. Auxiliary equipment such as a thermometer and gauge for the water storage tank are provided, as well as switch means for controlling the operation of the heating element. A safety warning light is positioned at the top of the enclosure, and indicia may be painted on all of the walls and the door of the enclosure to proclaim that the unit is for emergency use. The unit, while occupying essentially the same amount of ground area as a conventional emergency shower installation, is more visible than a conventional installation, and, because of its walled construction, is far less susceptible to damage by moving vehicles in an industrial site, or by vandalism.

The foregoing, and other features and advantages of the unit, will become apparent from the following description when taken in conjunction with the accompanying drawings wherein.

Figure 1:
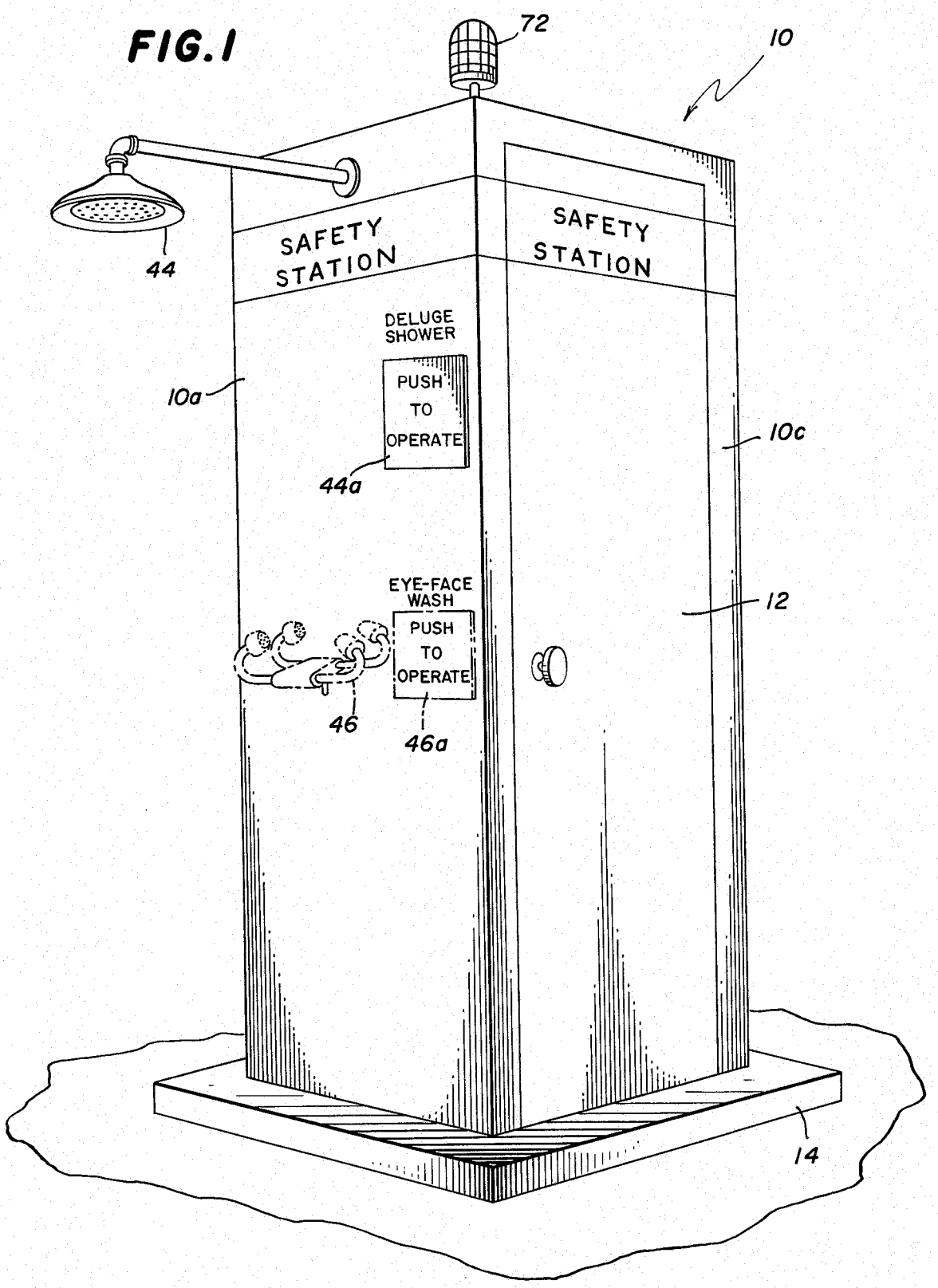
FIG. 1 is a view in perspective of an embodiment of the invention.
Figure 2:
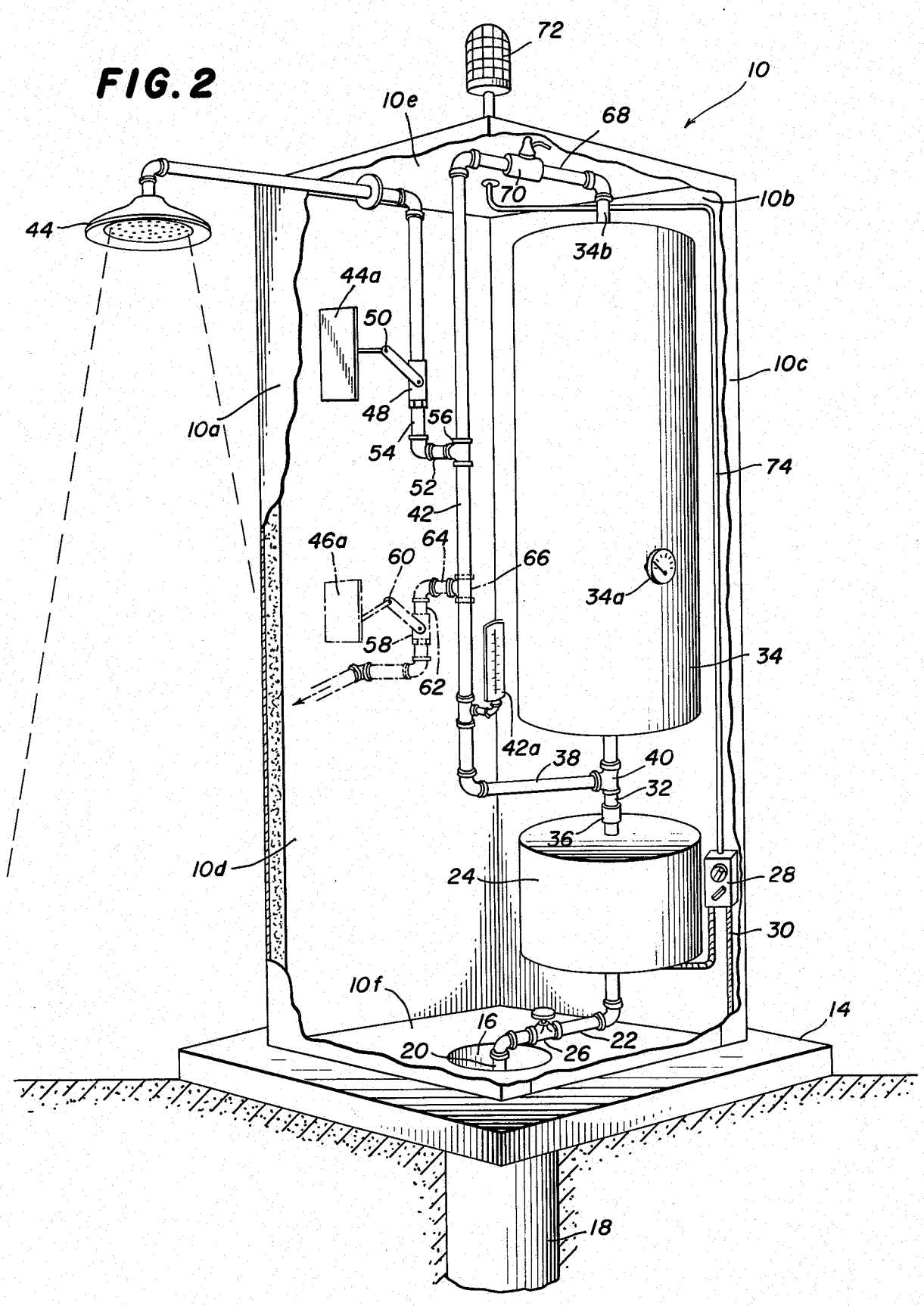
FIG. 2 is a view in perspective with a portion of the outer wall and the door broken away to show the elements of the unit within the walled enclosure comprising the unit.

Referring, now, in greater detail to FIGS. 1 and 2 of the drawings, the embodiment of the invention illustrated comprises an enclosure 10 having side walls **10*a* and 10*b*, a front wall 10*c* and a rear wall 10*d*, and a ceiling 10*e* and a floor 10*f*. The front wall 10*c* of the enclosure includes a door 12. A lock (not shown) desirably is provided for the door 12. As best shown in FIG. 2, the side walls 10*a* and 10*b*, as well as the front wall 10*c*, including the door 12, and the rear wall 10*d* and the ceiling 10*e***, are insulated.

The enclosure 10 desirably is supported on a base 14 at or above ground level. The base 14 advantageously comprises a metal plate which is integrally secured to the sidewalls of the enclosure 10. The plate may be provided with openings (not shown) at the corners and sides thereof to enable the enclosure to be bolted or otherwise anchored in position on a pre-poured concrete slab, or on an asphalt surface. The base 14, as shown in FIG. 2 of the drawings, is provided with a central opening which is in register with an opening 16 in the floor 10*f* of the enclosure 10. An underground transit pipe 18 is concentrically positioned with respect to the openings in the base 14 and the floor 10*f*. The pipe 18 serves as a housing for a water conduit 20 connected to a conduit (not shown) buried below the frost line and connected to a source of water.

The supply conduit 20 is connected through a conduit 22 to an electric water heater 24. A shut-off valve 26 and a union (not shown) advantageously are positioned in the conduit 22 between the conduit 20 and the heater 24 to facilitate the repair or replacement of elements upstream of the supply conduit 20. The heater 24 is connected to a switch 28 mounted on the side wall 10*b*. The switch 28, in turn, is connected by a cable 30 to a source of electric current. Automatic control means (not shown) are provided for the heater 24 to maintain the water stored in the unit at a preselected temperature.

The water heater 24 is connected through a conduit 32 to a water storage tank 34. A check valve 36 is positioned in the conduit 32 above the heater 24. The capacity of the tank 34 can range from 30 to 60 gallons, more or less. Generally speaking, however, a tank having a capacity of from 40 to 50 gallons is adequate for most purposes. A gauge 34*a* to indicate the level of the tempered water in the tank 34 is located on the side of the tank 34 nearest the door 12. As indicated, the water storage tank and the water heater may comprise an integral, self-contained unit.

A feeder conduit 38, provided with a union (not shown), is connected to the conduit 32 through a TEE fitting 40. The conduit 38, in turn, is connected to a main feeder conduit 42 which conveys tempered water from the tank 34 to the deluge or drench shower 44, and an eye/face wash fixture 46 (shown in broken lines) which extend outwardly from the side wall 10*a* of the enclosure 10. A thermometer 42*a* is connected to the conduit 42 to enable the easy determination of the temperature of the water flowing to the shower 44 and the fixture 46.

Operation of the shower 44 is controlled by means of a ball valve 48 which is linked by a toggle joint 50 to the inner surface of a push plate 44*a* positioned in the side wall 10*a* within easy reach of a person requiring the use of the shower 44. The ball valve 48 advantageously is of the stay-open type so that, once it is opened by pushing the plate 44*a* inwardly, a user will not have to hold his hand on the plate 44*a* continuously during use of the shower. The ball valve 48 is connected to the main feeder conduit 42 through nipples 52 and 54, and TEE fitting 56.

Operation of the eye/face wash fixture 46, when such a fixture is a part of the freeze proof unit, is controlled by means of a ball valve 58 connected by a toggle joint 60 to the inner surface of a push plate 46*a* positioned in the wall 10*a*, below and in spaced relation to the push plate 44*a* for the shower 44. The ball valve 58, like the ball valve 48, advantageously is of the stay-open type. The valve 58 is connected to the main feeder conduit 42 through nipples 62 and 64, and TEE fitting 66.

The upper end of the main feeder conduit 42 is connected to an expansion conduit 43*b* at the top of the tank 34 through a conduit 68. A relief valve 70 is located in the conduit 68.

Extending upwardly and outwardly from the ceiling 10*e* of the enclosure 10 is a safety warning light 72. The light 72 is connected to the switch 28 by a cable 74. Apart from its function as a signalling device, the light 72 can serve as a means for indicating whether the unit is receiving power. More specifically in this connection, a power failure will cause the light 72 to go out.

The freeze proof unit of the present invention, while insuring an always-ready, large volume of tempered water for emergency use, provides complete protection against the elements for all working parts of the unit. In addition, the rugged construction of the unit provides excellent protection against damage caused by human error, accidental, or otherwise, and vandalism. These objectives are achieved, moreover, while enabling ready access to the working parts of the unit for purposes of maintenance or repair.

While the invention has been described in relation to a specific embodiment, it should be understood that various modifications may be made in the unit without departing from the spirit and scope of the invention.

What is claimed is:

1. A stationary freeze proof emergency shower unit capable of supplying a high volume of pretempered water at a desired temperature to an individual using the unit irrespective of the temperature of the ambient air surrounding the unit, comprising an insulated walled enclosure rigidly anchored in place at a preselected site, said enclosure having top, bottom and side walls, one of the side walls having a door permitting access to the interior of the enclosure, a deluge shower extending through and outwardly from a side wall of the enclosure and positioned at a height with relation to the bottom wall of the enclosure to enable a person standing under the deluge shower on the outside of the enclosure to stand in a substantially upright position, a tempered water storage tank within the enclosure connected to a source of water and to the deluge shower, water temperature control means within the enclosure associated with the tempered water storage tank for automatically maintaining the water in the storage tank at a preselected temperature irrespective of the temperature of the air on the outside of the enclosure, and deluge shower control means including valve means positioned within the enclosure between the storage tank and the deluge shower and valve control means operable from outside the enclosure for enabling a person to open the valve means within the enclosure to cause a high volume of tempered water at a preselected temperature to flow from the tempered water storage tank in the enclosure to the deluge shower on the outside of the enclosure.

2. A freeze proof emergency shower unit according to claim 1 wherein an eye/face wash fixture extends outwardly from a side wall of the enclosure, and separate control means operable from outside the enclosure is provided for enabling a user to cause water to flow from the tempered water storage means to the eye/face wash fixture.

3. A freeze proof emergency shower unit according to claim 1 wherein the walled enclosure is connected to a separate base for rigidly supporting the unit at or above ground level and for securing the unit in a fixed position at a preselected location.

4. A freeze proof emergency shower unit according to claim 1 wherein the water storage tank and the water temperature control means comprises an integral body, and the water temperature control means is an automatically controlled electric water heater connected to a source of non-tempered water.

5. A freeze proof emergency shower unit according to claim 1 wherein the shower control means includes a push plate positioned in the side wall of the enclosure through which the deluge shower extends, said push plate serving to open the valve means on the inside of the enclosure to cause tempered water to flow from the tank.

6. A freeze proof emergency shower unit according to claim 1 wherein a permanently lit safety warning light is positioned on the outside of the top wall of the enclosure.

* * * * *